United States Patent [19]

Swift

[11] Patent Number: 4,506,921

[45] Date of Patent: Mar. 26, 1985

[54] SECURITY SEAL

[75] Inventor: Allan W. Swift, Denville, N.J.

[73] Assignee: E. J. Brooks Company, Newark, N.J.

[21] Appl. No.: 451,920

[22] Filed: Dec. 27, 1982

[51] Int. Cl.[3] ..... B65D 27/30

[52] U.S. Cl. ..... 292/318; 292/322

[58] Field of Search ..... 292/307, 316–322, 292/DIG. 49, DIG. 38; 16/221, 232, 225, 277, 286, 293, 295, 374

[56] References Cited

U.S. PATENT DOCUMENTS

| | | | |
|---|---|---|---|
| 1,028,253 | 6/1912 | Murray | 292/317 |
| 3,466,077 | 9/1969 | Moberg | 292/322 |
| 3,628,215 | 12/1971 | Everburg | 16/293 |
| 3,712,655 | 1/1973 | Fuehrer | 292/321 |
| 3,717,369 | 2/1973 | Stoffel et al. | 292/321 |
| 4,229,031 | 10/1980 | Guiler | 292/322 |
| 4,319,776 | 3/1982 | Moberg | 292/322 |
| 4,414,705 | 11/1983 | Ostrowsky | 16/225 |
| 4,424,994 | 1/1984 | Dowden | 292/318 |

*Primary Examiner*—Gary L. Smith
*Assistant Examiner*—Thomas J. Dubnicka
*Attorney, Agent, or Firm*—Robert E. Ross

[57] ABSTRACT

A security seal of the type in which a stud and socket are hinged together for movement into locking engagement, in which means is provided for imparting a disengaging force to the stud and socket when they are moved toward engagement, so that if the stud and socket do not become securely locked together, they will spring apart.

5 Claims, 3 Drawing Figures

SECURITY SEAL

BACKGROUND OF THE INVENTION

In U.S. Pat. No. 4,319,776 issued Mar. 16, 1982 there is disclosed and claimed a security seal formed of a single piece of molded plastic, comprising a pair of legs mounted on a base and carrying on their free ends locking stud and socket members adapted for locking engagement when the legs are flexed together. To cause the stud and socket members to separate if they are not securely engaged, an additional spring is formed which extends between the legs and is flexed when the legs are flexed together. The leg spreading force applied by the additional spring causes the legs to separate if the stud has not securely locked in the socket.

SUMMARY OF THE INVENTION

This invention provides a security seal of the general type described above, in which a base is provided with a fixed leg and a movable leg extending therefrom, said legs having a cooperating stud and socket on the ends thereof for locking engagement when the movable leg is flexed toward the fixed leg. To provide additional disengaging force to the legs to insure that the legs will separate if the stud and socket are not securely engaged, a tension spring is provided which extends from the base to the flexible leg around the outside of the hinge connecting the flexible leg to the base, said spring being in tension when the stud and socket are engaged.

In one embodiment of the invention a hinge connecting the flexible leg to the base is shaped to become completely closed before the stud and socket become engaged, so that resilient bending of the movable leg is required to allow locking of the stud and socket. A greater spring back force is thereby applied to the stud and socket to insure that they will separate if not securely locked together.

DESCRIPTION OF THE ILLUSTRATED EMBODIMENT

Figure 1:
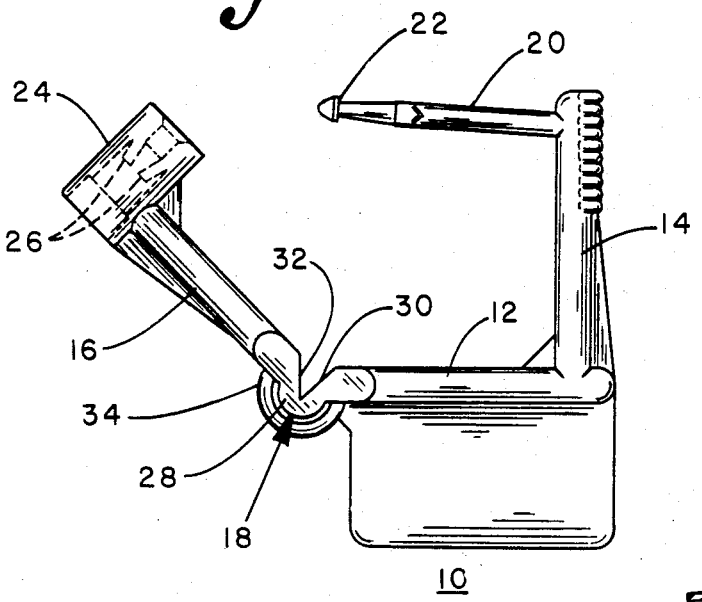
FIG. 1 is a view in elevation of a seal embodying the features of the invention, in the open position.
Figure 2:
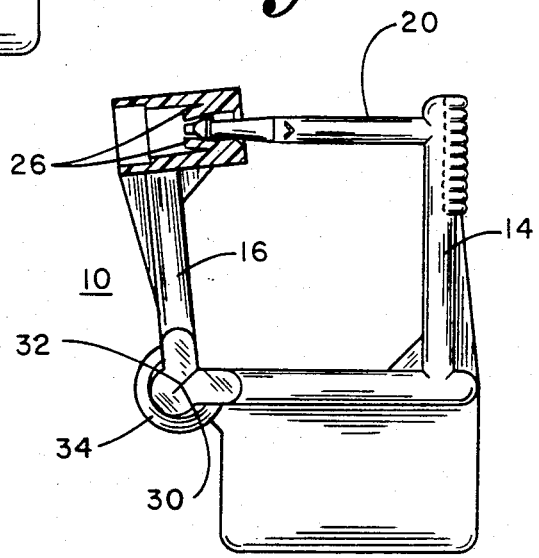
FIG. 2 is a view of the seal of FIG. 1 in the partly closed position, illustrating the closing of the hinge prior to the locking of the stud and socket assembly.
Figure 3:
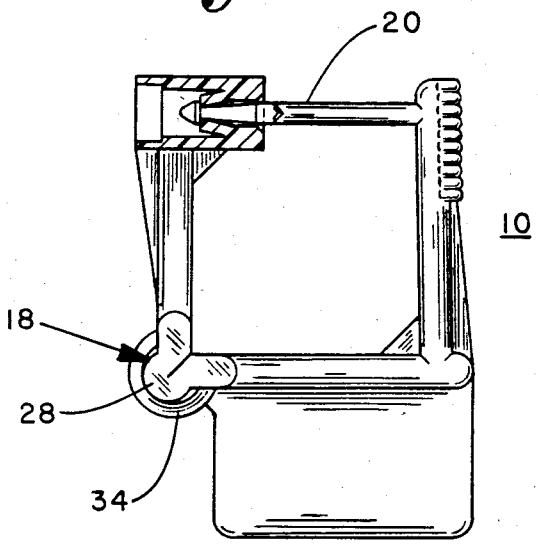
FIG. 3 is a view of the seal of FIGS. 1 and 2 in the locked condition.

Referring to the drawing, there is illustrated a seal 10, which comprises a base portion 12, a fixed leg 14 extending upwardly from one end of the base and a movable leg 16 connected to the other end of the base by a hinge 18 and diverging from the fixed leg 14.

Extending from the distal end of the fixed leg 14 is a stud member 20 which has a locking shoulder 22 near the free end thereof for locking engagement with a cooperating socket 24 disposed on the free end of the movable leg 16. The socket has internal flexible fingers 26 dimensioned to receive the stud in locking engagement in a manner known in the art.

The socket 24 and the stud 20 are positioned and oriented that when the movable leg 16 is pivoted toward the stud 20, the stud enters the socket. The particular form of stud and socket illustrated herein is exemplary only, since other forms of stud and socket combinations may be used without departing from the scope of the invention.

The hinge 18 comprises a medial web portion 28 which projects outwardly from the intersection of the movable leg and the base. A pair of flat surfaces 30 and 32 are provided on the inside of the portion of the base and movable leg adjacent to the hinge for a purpose to appear hereinafter.

A tension spring 34 extends around the outside of the hinge 18 and the web portion 28, and is joined at the ends to the adjacent portions of the movable leg and the base.

In the illustrated embodiment of the invention the seal, including the spring 34, is formed of a single piece of molded resilient plastic and when originally molded is in the form shown in FIG. 1.

Hence when the movable leg is pivoted toward the fixed leg, the spring 34 is stretched around the outside of the outwardly projecting web portion 28 of the hinge to that tension is applied to the spring, to provide an opening force to the movable leg. Therefore if the stud is not securely locked in the socket, the stud will back out of the socket when the fingers release the seal. Since the seal is formed of plastic, the spring 34 will eventually lose some of its tension, however it will retain the initial tension for a considerable time after the seal is closed, and in any event long enough for the seal to open if not securely fastened.

In the illustrated embodiment of the invention, the flat surfaces 30 and 32 are disposed at an angle to each other such that when the movable leg is pivoted about the hinge web 28, the flat surfaces bear against each other before the stud has become locked in the socket. Therefore to effect locking of the stud in the housing, the movable leg 16 must be resiliently bent to allow the stud to move further into the housing so that after locking the flexed movable member provides additional spring-back force to the assembly.

In the illustrated embodiment of the invention, the end of the socket opposite the end receiving the stud is open, providing an economical seal of relatively low security. If a seal with higher security is desired, a plug may be assembled into the rear end of the socket and heat sealed in place, as shown and claimed in U.S. Pat. No. 4,229,031, or the rear end may be closed in the manner shown in U.S. Pat. No. 3,466,077.

Since certain other changes apparent to one skilled in the art may be made in the herein described embodiments of the invention without departing from the scope thereof, it is intended that all matter contained herein be interpreted in an illustrative and not a limiting sense.

I claim:

1. A one piece plastic seal, comprising a pair of relatively movable members joined at a flexible hinge, said members carrying cooperating means for locking together and being movable together about said hinge to effect locking engagement of said cooperating means, and tension spring means attached to the members and extending around the outside of the hinge, said spring means being dimensioned to be placed in tension when the members are moved together to engage said fastener portions, in which a portion of the members adjacent said hinge have surfaces adapted to abut each other before said cooperating means become engaged when the members are pivoted toward the locking position, whereby resilient flexing of at least one of said members is required to effect engagement of said cooperating means.

2. A seal as set out in claim 1 in which said hinge has a portion extending outwardly from the junction of the members, said spring extending around the outer surface of said outwardly extending portion.

3. A one piece plastic seal comprising a relatively rigid member and a flexible member joined at a flexible hinge, said members carrying cooperating locking fastener portions and being movable together about said hinge to effect locking engagement of said fastener portions, said members having portions near the hinge which are positioned to abut each other before engagement of the fastener portions when the members are moved together, whereby to effect engagement of the fastener portions the flexible member must resiliently bend, whereby a disengaging force is applied to the engaged fasteners.

4. A seal as set out in claim 3 in which spring means is provided between the flexible member and the rigid member, said spring being dimensioned to be placed in tension when the members are moved to the locking position to provide additional disengaging force to the engaged stud and socket.

5. A seal as set out in claim 4 in which said spring means is a tension spring extending around the outside of the hinge from positions on the members near the hinge.

* * * * *